US005099871A

United States Patent [19]

Cowan

[11] Patent Number: 5,099,871

[45] Date of Patent: Mar. 31, 1992

[54] LOW FRICTION PROPORTIONAL UNLOADING VALVE

[75] Inventor: Phillip L. Cowan, Kingwood, Tex.

[73] Assignee: Binks Manufacturing Company, Franklin Park, Ill.

[21] Appl. No.: 707,697

[22] Filed: May 30, 1991

Related U.S. Application Data

[63] Continuation-in-part of Ser. No. 519,936, May 7, 1990, abandoned.

[51] Int. Cl.[5] ..... F16K 17/04

[52] U.S. Cl. ..... 137/116; 137/569

[58] Field of Search ..... 137/116, 117, 569, 497, 137/901, 115, 494

[56] References Cited

U.S. PATENT DOCUMENTS

| | | | |
|---|---|---|---|
| 1,407,016 | 1/1922 | Raymond | 137/494 X |
| 1,636,561 | 7/1927 | Hazard | 137/116 |
| 1,779,640 | 10/1930 | Rayfield | 137/116 |
| 3,143,134 | 8/1964 | Karpis | 137/489 X |

FOREIGN PATENT DOCUMENTS

| | | | |
|---|---|---|---|
| 668644 | 8/1963 | Canada | 137/115 |

*Primary Examiner*—Stephen M. Hepperle
*Attorney, Agent, or Firm*—Juettner Pyle & Lloyd

[57] ABSTRACT

A low friction proportional unloading valve mechanism for pressurized fluid circuits incorporating a valve housing forming primary and bypass fluid circuits. A normally closed unloading valve normally prevents the flow of incoming fluid to the bypass fluid circuit and is opened by a pressure responsive valve actuator. The valve actuator forms a pressure responsive wall and may take the form of spaced diaphragms or a deformable flexible hose that induces opening force to the unloading valve in direct proportion to the pressure in the primary fluid circuit. upon opening of the unloading valve, a check valve in the primary fluid circuit prevents back flow and thus maintains valve controlling pressure on the movable wall structure of the valve actuator.

14 Claims, 3 Drawing Sheets

LOW FRICTION PROPORTIONAL UNLOADING VALVE

This is a continuation-in-part of copending application Ser. No. 07/519,936 filed on May 7, 1990, now abandoned.

BACKGROUND OF THE INVENTION

1. Field of the Invention

Provides a simple and reliable method and apparatus for unloading a positive displacement pump at a predetermined and adjustable level.

When the desired pressure level at the load circuit is reached, the device diverts the output from the pump back to the supply reservoir at very low pressure. When the pressure of the load circuit drops a predetermined amount, the flow is again directed to the load. In a preferred embodiment, the device utilizes no sliding seals under pressure and therefore it is particularly suitable for use where the fluid being pumped is abrasive as, and/or subject to drying or hardening, for example, paint. The device further provides a differential pressure between unloading and resumption of pumping, which is proportional to the pressure setting so that the relative pressure fluctuations at the load are approximately constant over the operating pressure range. The invention further provides for low friction operation.

Positive displacement pumps are extensively used in airless paint spraying. Such devices are generally mechanically driven by an electric motor or a gasoline engine. When the pump is driven by an electric motor, it is common practice to provide a switching mechanism which will turn the motor off at a predetermined load pressure and back on when the load pressure drops by a fixed amount. When a gasoline engine is used as a power source, the pump is typically turned on and off by an electrically actuated clutch between the engine and the pump.

In an electric pump of the type described above, there are disadvantages because of the frequent starting of the motor. The high starting currents required by a capacitor start motor can lead to overheating and also require very heavy supply wiring for proper performance.

In a gasoline pump of the type described above, there are disadvantages because of the complexity and cost of a drive train which requires an electrical power source on the engine, an electrical pressure sensing circuit, and an electrically actuated clutch. Rapid clutch cycling furthermore has been shown to lead to clutch overheating and excessive wear.

Many of the electric and gasoline drive machines currently available operate with a fixed pressure differential between cut-out and cut-in of the power source. If the differential is set high enough so that the machine does not cycle excessively at the high pressure settings, then the pressure variation at low pressure settings becomes unacceptable.

2. Discussion of the Prior Art

Many of the problems with machines which interrupt the drive to the pump can be solved by utilizing an unloading type of valve in the fluid circuit which diverts the flow from the load back to the source when the pressure reaches the desired level while the machine continues to operate. Unloader valves of this type are readily available and commonly used in hydraulic and water pumping applications. These devices have not heretofore found acceptance in paint pumps in part because they utilize high pressure sliding seals, generally U-cups or O-rings which may not be compatible with the environment in a paint pump where the fluid is very abrasive and subject to drying when left unused for extended periods of time.

SUMMARY OF THE INVENTION

It is a purpose of the invention to provide a pressure unloading valve which preferably utilizes no high pressure sliding seals and is compatible with an abrasive material such as paint.

It is a further purpose of the subject invention to provide a pressure unloading valve which has a pressure differential proportional to the operating pressure so as to maintain relative pressure fluctuations roughly constant over the operating pressure range of the device. As mentioned above, the present invention provides a simple and reliable method of unloading a positive displacement pump at a predetermined and adjustable level.

When the desired pressure level at the load circuit is reached, the device diverts the output from the pump back to the supply reservoir at very low pressure. When the pressure of the load circuit drops a predetermined amount, the flow is again directed to the load. A preferred embodiment of the device utilizes no high pressure sliding seals and therefore it is particularly suitable for use where the fluid being pumped is abrasive as, and/or subject to drying or hardening, for example, paint. The device further provides a differential pressure between unloading and resumption of pumping, which is proportional to the pressure setting so that the relative pressure fluctuations at the load are approximately constant over the operating pressure range. The preferred embodiment of the invention further provides for low friction operation.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

In the Drawings

FIG. 1 is a sectional view of a low friction unloading valve mechanism for positive displacement pumps which is constructed in accordance with the present invention and which is shown with its internal unloading valve element in the closed position for controlling normal flow of fluid to a load.

FIG. 2 is a sectional view of the unloading valve mechanism of FIG. 1 illustrating the unloading valve element being restrained at its open, fluid bypassing position by the internal pressure responsive valve actuator mechanism thereof for bypass of flow from the unloading valve back to the reservoir of the supply pump or to any other suitable reservoir.

FIG. 3 is a sectional view of a low friction proportional unloading valve mechanism representing an alternative embodiment of this invention and being shown with its internal unloading valve element in the closed position.

FIG. 4 is a sectional view of the alternative embodiment of FIG. 3 illustrating the internal unloading valve element being retained in its open, fluid bypassing position by the valve actuator mechanism of the unloading valve.

DETAILED DESCRIPTION OF THE PREFERRED EMBODIMENT

Figure 1:
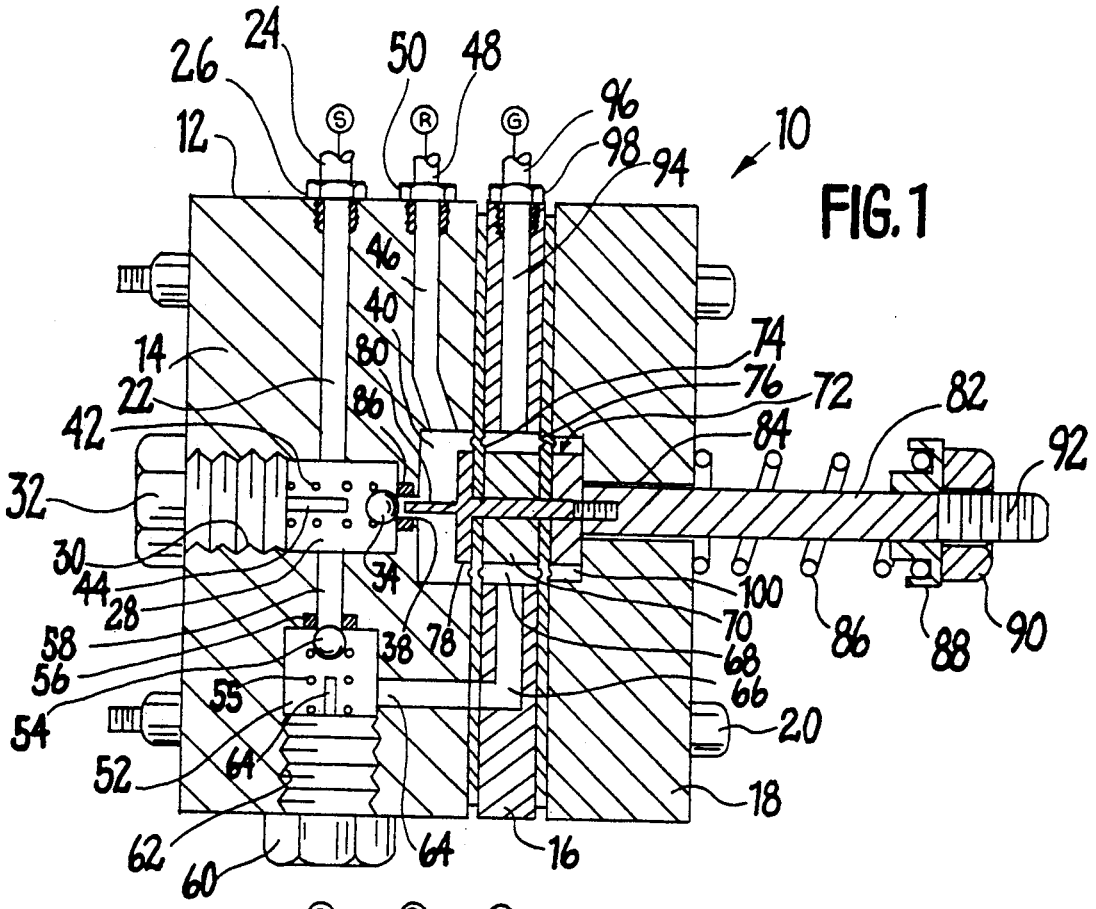
Figure 2:
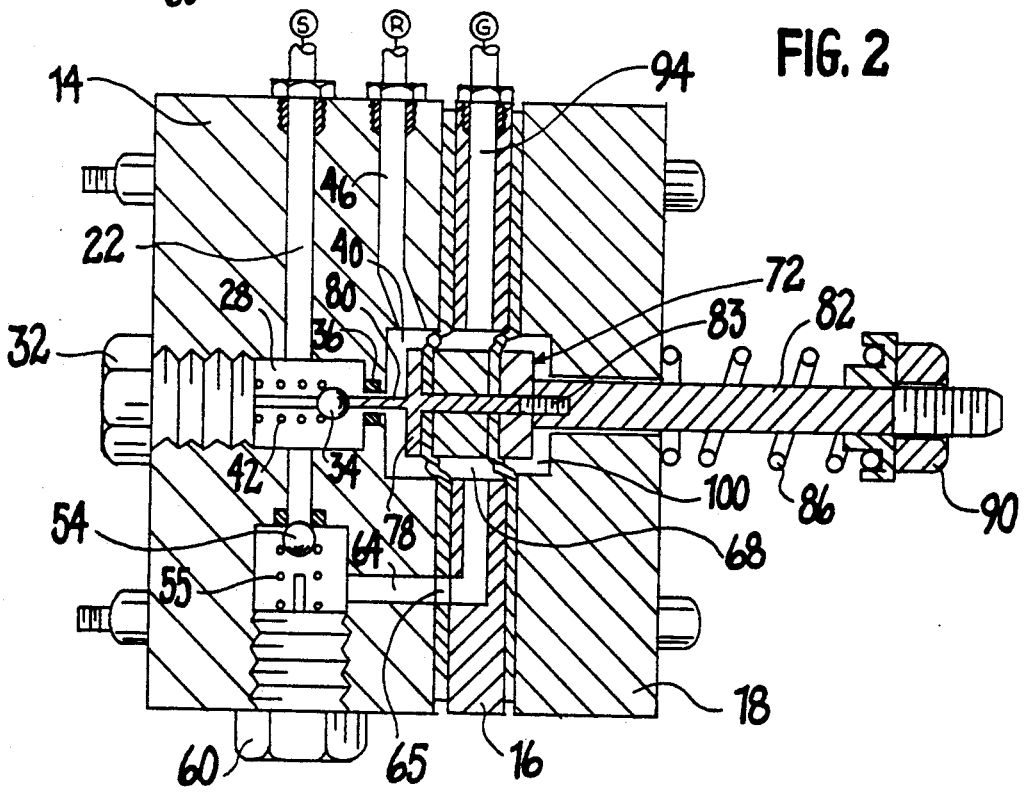

Referring now first to FIGS. 1 and 2, a proportional, low friction unloading valve embodying the present invention may conveniently take the form illustrated generally at 10 having a valve housing 12 composed generally of housing blocks 14, 16 and 18 which are secured in assembly by means of a plurality of bolts 20 that extend through appropriately registering bolt passages that are formed in the body blocks. The joints between the housing blocks are sealed by gaskets which also function as diaphragms as will be discussed herein below. It is also intended that, within the scope of the present invention, the housing blocks may be of any other suitable configuration and may be maintained in assembly in any suitable manner.

The housing block 14 defines an inlet passage 22 which is disposed in communication with a source "S" of pressurized fluid such as a positive displacement liquid pump by means of a supply conduit 24 which is secured in assembly with the housing block 14 by means of a suitable conduit retainer fitting 26. The fluid supply passage 22 is disposed in communication with an unloading valve cavity 28 which is formed within the housing block and which is accessible through a threaded opening 30 that is normally closed by a threaded cap or plug 32. An unloading valve element which may conveniently take the form of a valve ball as shown at 34 is disposed for sealing engagement with a circular valve seat 36. The valve seat is retained within a valve seat recess formed within the housing block 14 and forms a flow port 38. When the unloading valve element is unseated, fluid is allowed to flow from the valve cavity 28 through the flow port to a fluid bypass cavity 40 which is defined in part by the unloading valve housing block 14. The unloading valve element 34 is urged toward its seated relation with valve seat 36 by means of a compression spring 42 which is disposed about a spring guide extension 44 that projects from the inner extremity of the access cap 32. Thus, in the normal operating condition of the unloading valve mechanism the unloading valve ball element 34 will be seated against the valve seat 36 under the combined influence of the force applied thereto by the compression spring 5 and the force applied thereto by the pressure of the incoming fluid which is supplied to the valve cavity 28 by means of the inlet passage 22.

The inner extremity of the projection 44 also serves to limit opening movement of the unloading valve element 34 in the manner shown in FIG. 2.

A bypass passage 46 is also defined within the valve housing block 14 and is disposed in communication with the bypass cavity 40. The bypass passage 46 is in communication with a suitable reservoir R by means of a bypass conduit 48 which is secured in assembly with the housing block 14 by means of a suitable tube retainer 50.

The unloading valve housing block 14 also defines a valve cavity 52 within which is located a check valve element 54 which may also be defined by a valve ball. The check valve ball is urged by a compression spring 55 against a valve seat 56 which is retained within a suitable seat recess in the housing block which is located about a flow passage 58. The check valve cavity 52 is closed by means of an access plug or cap 60 which is threadedly received within an internally threaded access opening 62. A projection 64 extending from the inner end of the cap member 60 functions as a spring guide and also functions to restrain opening movement of the check valve element 54. The check valve is opened by fluid flow toward the load and is seated immediately upon cessation of flow or flow reversal to prevent backflow to the unloading valve cavity.

A fluid flow passage 64 formed in the housing block 14 extends from the check valve chamber 52 and is disposed in communication with a flow passage 66 formed in the housing block 16. The gasket member which also forms one of the valve actuator diaphragms to be discussed hereinbelow forms a port 65 through which fluid in passage 64 flows and provides a seal between the housing sections 14 and 16. Other sealing devices such as O-rings may be employed to seal the joint between the body sections 14 and 16 at the passage 64. The flow passage 66 intersects an annular cavity 68 which is cooperatively defined by the central piston section 70 of a valve actuator member 72 and by a pair of spaced diaphragms 74 and 76 which also serve as gaskets between the respective housing blocks 14, 16 and 18. The central piston section 70 of the valve actuator piston 72 is essentially a spacer between the diaphragms 74 and 76 which is retained in assembly with the valve actuator 72 by means of a retainer member 78. The retainer is provided with a valve actuating extension 80 which is positioned in registry with the flow port 38 and which is adapted to unseat the unloading valve 34 in the manner shown in FIG. 2 upon pressure induced movement of the valve actuator. It should be borne in mind that the specific construction of the valve actuator and unloading valve that is illustrated in FIGS. 1 and 2 is intended only as a representative example. The unloading valve and valve actuator may take any other suitable form within the spirit and scope of the present invention.

It is desirable that the valve actuator piston 72 be normally positioned as shown in FIG. 1 so that the unloading valve element 34 will normally remain seated by the force of the spring 42 and by the pressure in the valve cavity 28 during the flow of fluid through the unloading valve mechanism and below a predetermined pressure. It is also desirable that the valve actuator mechanism be movable to the left as shown in FIG. 2 to a position unseating the unloading valve when the pressure of the flowing fluid reaches a predetermined maximum pressure. In one suitable form of the invention, a mechanism for accomplishing these features may conveniently take the form shown in FIGS. 1 and 2. A pressure adjustment stud 82 extends from the valve actuator 72 through a passage 84 formed by the housing block 18. The pressure adjustment stud is secured to a threaded extension 83 of the retainer member 78. A compression spring 86 is positioned about the valve actuator stud with its outer extremity being supported and positioned by a spring retainer 88. A pressure adjustment nut 90 having threaded engagement with a threaded outer portion 92 of the valve actuator stud is utilized to adjust the compression of the spring 86 and achieve adjustment of the unloading pressure for which the unloading valve mechanism is set.

The annular cavity 68 is sealed at both axial ends by the diaphragms 74 and 76 and is in communication with an outlet passage 94 through which the fluid is transported under pressure out of the valve to the load. An outlet conduit 96 is retained in assembly with the housing block 16 by means of a suitable tube retainer 98. The outlet conduit transports the pressurized fluid to a load such as a fluid control device such as a paint gun "G".

The valve actuator 72 is generally designated in the form of a piston which is centered in the chamber 40 and which is fixed to the spaced diaphragms 74 and 76 by means of a threaded extension of the retainer 78, which threaded extension is received by an internally threaded receptacle of the valve actuator stud 82.

The diaphragm 74 is supported on its outer surface (away from the pressurized fluid) by the circumference of the recess or cavity 40 in the housing block 14. The diaphragm 76 is supported on its outer surface (away from the pressurized fluid) by the circumference of a valve actuator recess 100 which is formed in the housing block 18. As shown in FIGS. 1 and 2, the diameter of the recess 40 is slightly larger than the diameter of the recess 100 thereby causing the pressure exposed area of the diaphragm 74 to be slightly greater than the pressure exposed area of the diaphragm 76. Therefore, the pressure acting in the annular cavity 68 acts on the diaphragms 74 and 76 thereby inducing a net force differential on the valve actuator 72 that urges the valve actuator to the left as shown in FIGS. 1 and 2. This net force differential is equal to the pressure in the annular cavity 68 multiplied by the difference in the cross-sectional areas of cavities 40 and 100. The difference in these areas is therefore referred to herein as the effective diaphragm area.

As the pressure in the annular cavity 68 rises and approaches the desired unloading pressure, the net diaphragm force to the left will also increase and will compress the spring 86 and move the valve actuator piston 72 to the left until the valve actuating extension 80 contacts the unloading valve ball element 34. Because the unloading valve ball is held against the valve seat 36 by the pressure of the fluid in the valve cavity 28, the leftward motion of the piston will then cease until the net diaphragm force to the left is sufficiently great to overcome the combined forces of the spring 42 and the pressure differential across the unloading valve. When these combined forces are overcome by the force applied to the valve element 34 by the valve actuator extension 80, the unloading valve will be unseated.

When the valve ball 34 is unseated by pressure induced operation of the valve actuator piston, the force opposing the leftward motion of the valve actuator piston is suddenly decreased and the piston will then move to the left, lifting the unloading valve ball well clear of the seat 36, thus permitting the incoming fluid to the valve to travel with little or no pressure drop past the unloading valve ball and into the bypass cavity 40 and bypass conduit 46.

The pressure in the annular cavity 68 and the load passage 94 will remain unaffected by opening of the unloading valve element 34 because the check valve ball 54 will be quickly seated against the valve seat 56 by the combined forces of the compression spring 55 and the pressure within the check valve cavity 52. Thus, the check valve 54, upon opening of the unloading valve 34 will immediately close, preventing backflow of fluid to the unloading valve chamber 28 and permitting pressure within the annular cavity 68 to remain substantially at the preset unloading pressure so that the valve actuator piston 72 remains positioned as shown in FIG. 2, thus maintaining the unloading valve in its open position.

When the fluid pressure in the discharge passage 94 is subsequently decreased, such as by opening of the control valve of a fluid dispensing gun "G", the unloading valve ball 34 will not be permitted to seat against the valve seat 36 until the leftward net diaphragm force applied to the valve actuator piston is decreased by an amount equal to the sealing force of the unloading valve ball 34 against the valve seat 36 at the unloading pressure. It will be evident that the relative magnitudes of the cut-out and cut-in pressures or relative differential will be determined by the seating area of the unloading valve ball 34 in seat 36 and by the effective diaphragm area.

The use of double spaced diaphragms with an effective area much smaller than the area of each individual diaphragm renders it possible to simulate a small diameter diaphragm but achieve the longer travel which is possible only with larger diaphragms. Significant travel of the valve actuator piston is necessary for satisfactory operation of the device. Furthermore, use of the preferred double diaphragms completely eliminates the need for sliding seals of any type and therefore provides a low friction, low wear pressure unloading valve device. The operating or unloading pressure of the valve can be easily controlled by varying the precompression on the spring 86. Whereas diaphragms are preferred for sealing the actuator to the housing, other types of high pressure seals, such as U-cups, O-rings and wiper seals, may be used and are within the spirit and scope of the present invention.

It is desirable to mount the unloading valve mechanism with the inlet conduit 22 as close as possible to the discharge of the pump providing the pressure source "S" so as to minimize the quantity of fluid stored under pressure between the unloading valve ball 34 and the fluid pump. For the same reason, it would be advisable not to use a flexible hose to connect the pump to the unloading valve. Large volumes of fluid stored upstream of the unloading valve ball will exhaust past the check valve ball as the valve mechanism unloads and can lead to accelerated wear on the unloading valve ball.

Figure 3:
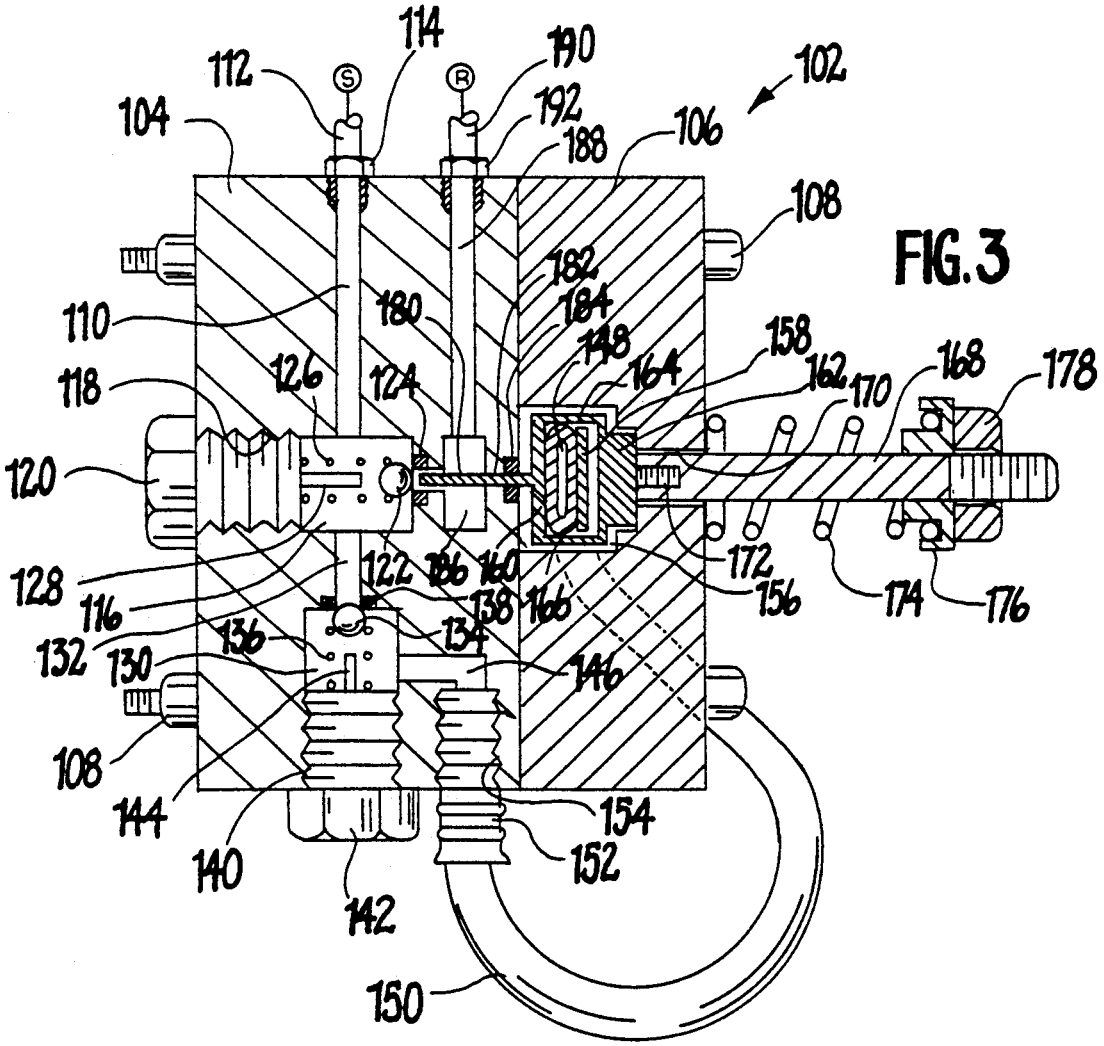
Figure 4:
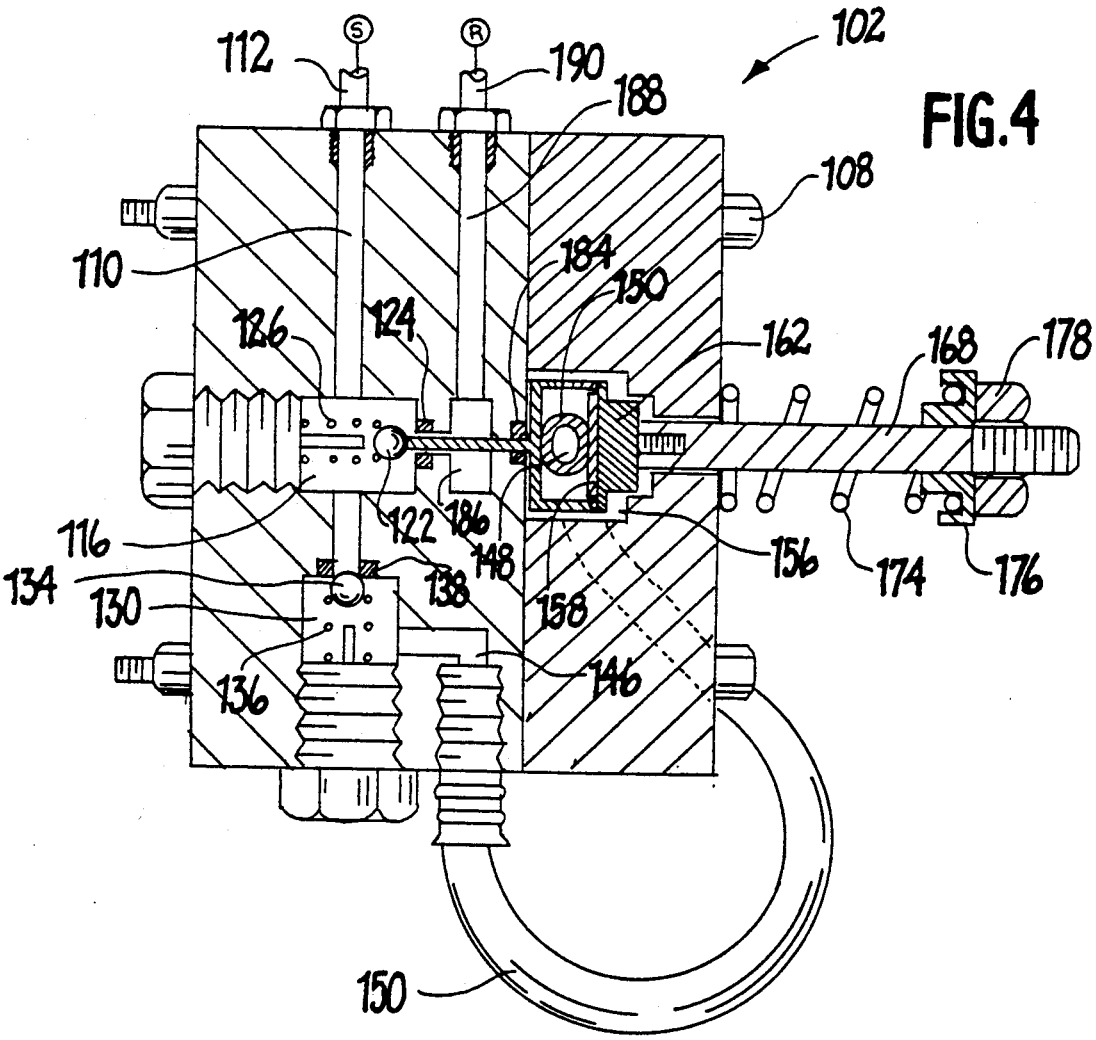

An alternative embodiment of this invention is illustrated in FIGS. 3 and 4 wherein the pressure deformable wall means afforded by the spaced diaphragms 74 and 76 in FIGS. 1 and 2 is replaced by a deformable tubular hose or conduit which is normally maintained in an out-of-round or elliptical configuration by the mechanical force of a valve actuator mechanism and which forms pressure deformable wall means which is urged toward a circular cross-sectional configuration by the pressure of fluid flowing through the conduit.

The operation of this alternative unloading valve mechanism can be explained with reference to FIG. 3 which shows the unloading valve mechanism in its rest or zero pressure condition and with reference to FIG. 4, which illustrates the unloading valve mechanism in its unloaded or fluid bypassing condition. This alternative unloading valve mechanism is illustrated generally at 102 and incorporates a pair of housing blocks 104 and 106 that are maintained in assembly by means of a plurality of bolts 108 or by any other suitable means of assembly. The housing block 104 is provided with an inlet conduit or passage 110 which receives pressurized fluid from a suitable source "S" such as a positive displacement pump, the fluid being conducted to the passage 110 by means of a supply conduit 112 secured to the housing block 104 by means of a suitable tube retainer 114. The housing block is also formed to define an unloading valve cavity 116 having its internally threaded access opening 118 closed by means of a cap or plug member 120. Within the unloading valve cavity is movably disposed an unloading valve element 122 in the form of a check valve ball which is normally retained in seating engagement with a valve seat 124 by the force of a compression spring 126 and by the force induced to the unloading valve ball by pressure within the valve cavity 116. The plug or cap 120 is provided with a projection 128 which functions as a guide for the compression spring 126 and which also functions to limit opening movement of the unloading valve ball 122.

Downstream of the unloading valve chamber 116 the housing block 104 defines a check valve cavity 130 which is in communication with the chamber 116 by means of a fluid passage 132. A check valve ball 134, movably disposed within the check valve cavity 130, is normally urged by the force of a compression spring 136 into sealing engagement with a valve seat 138 encompassing the juncture of the flow passage 132 and the check valve cavity 130. An internally threaded access opening 140 of the check valve cavity 130 is closed by a threaded plug or cap 142 which also carries a spring guide extension 144 as shown.

The incoming pressurized fluid received by the conduit or passage 110 flows through the unloading valve cavity 116 and through passage 132 to the check valve chamber 130 unseating the check valve 134. The flowing fluid then exits the check valve chamber via a passage 146 of the housing block 104 and enters the passage 148 of a flexible conduit 150 which is secured to the housing block 104 by a tube connector 152 that is received by an internally threaded receptacle 154. The cooperating housing blocks 104 and 106 define a generally rectangular valve actuator opening 156. The flexible conduit 150 extends through the rectangular opening where it is received between a fixed valve actuator element 158 and a structural plate or wall element 160 of a movable valve actuator element 162. The valve actuator element 162 is essentially in the form of a generally rectangular cage having side plates 164 and 166 which interconnect valve actuator elements 160 and 162. The fixed plate member 158 extends from the wall structure of the housing block 106 and functions to restrain the hose 150 as it is deformeed to an elliptical configuration by the plate or wall 160 of the movable valve actuator cage in the manner shown in FIG. 3. A valve actuator stud 168 extends through an opening 170 in the housing block 106 and is received by a threaded extension 172 of the movable valve actuator cage 162. The valve actuator stud 168 is urged outwardly by means of a compression spring 174 having its outer end received by a spring retainer 176. The compression of the spring 174 is adjusted by means of an adjustment nut 178 to thus accomplish appropriate adjustment of the unloading pressure at which the unloading valve ball 122 is unseated and opened. The valve actuator structure 162 further incorporates a valve actuating projection 180 which extends from the plate or wall 160 through an opening 182 in the wall structure of the housing block 104 and is sealed with respect to the housing block by means of a sealing element 184 that is retained within the appropriate recess in the housing block. The sealing element 184 prevents leakage of fluid from the cavity 186 to the cavity 156. The valve actuating projection 180 extends into a bypass cavity 186 and into the flow port which is cooperatively defined by the body block 104 and the valve seat 124. The housing block 104 further forms a bypass passage 188 which is in communication with the bypass chamber 186 and which delivers bypassed fluid to a conduit 190 which returns the fluid back to the source "S" or to any suitable reservoir "R". The return conduit 190 is connected to the housing block 104 by means of a tube retainer element 192.

As shown in FIG. 3, the cage structure defined by the valve actuator 162 surrounds the flexible tube extending through the rectangular opening 156 of the housing block 106 and the compression spring 174 urges the cage structure outwardly thereby compressing the flexible conduit against the fixed element 158. This compression flattens the flexible conduit essentially as shown in FIG. 3. After passing through the cage structure 162, the flexible conduit exits the rectangular opening 156 in the housing block and delivers the pressurized fluid to a suitable load such as a paint gun.

As pressure in the flexible conduit 150 rises, the pressure will act on the internal surface of the flattened portion of the hose within the cage structure, tending to return it to a circular configuration. The force thus generated by the expanding flexible hose will be transmitted through the cage 32 to the adjustment stud 168 and will exert a compressive force on the spring 174. As the flexible hose begins to expand toward a more circular cross-sectional configuration, the cage structure and the valve actuating projection 180 are moved to the left toward the unloading valve ball 122. As the load pressure rises, the spring precompression will be overcome and the valve actuator cage 162 will move to the left until the valve actuating projection 180 extending from structural member 160 of the cage contacts the unloading valve ball 122. The leftward motion of the cage 162 will then cease until the pressure rises further and generates sufficient force to cause the valve actuating projection 180 to lift the unloading valve ball 122 free of the seat member 124. The sudden increase of the force applied by the valve actuator cage to the compression spring 174 by unseating of the unloading valve ball 122 will permit the valve actuator cage to rapidly move to the left and lift the unloading valve ball 122 well clear of it seat 124. The incoming fluid from the pump in conduit 110 will thus pass unimpeded from the unloading valve cavity 116 to the bypass cavity 186 and then through passage 188 and conduit 190 back to the supply container of the pump at virtually zero pressure. The O-ring member 184 prevents the fluid in cavity 186 from leaking along the valve actuator projection 180 into the valve actuator chamber 156. Since there is little or no pressure within the bypass cavity 186 and only atmospheric pressure in valve actuator cavity 156, there is no high pressure loading on the seal member 184 and, because of its small diameter, the frictional load of the valve actuating mechanism will be very small in comparison to the other forces acting to open or permit closure of the unloading valve element 122.

The pressure in the flexible conduit 150 and the load circuit will not decrease when the unloading valve ball 122 is unseated because of the action of the check valve ball 134 which is quickly seated in response to the pressure change in the unloading valve chamber 116 to prevent backflow of pressurized fluid from the check valve chamber 130. When the pressure in the load circuit is decreased, such as by opening of the flow control valve of a paint gun, the valve actuating cage 162 will move to the right as shown in the FIGS. until the unloading valve ball 122 reseats against seat 124. In this position, the incoming fluid will again be delivered to the load circuit. The relative pressure differential between unseating and seating of the unloading valve ball 122 can be controlled by the mechanical design of the components. Typically, the compressive force of the spring 174 as the unloading valve ball 122 is about to unseat, should be about 4 to 5 times the seating force on the unloading valve ball 122, for about a 20% relative pressure differential. For smaller pressure differentials, the compressive force of the spring 174 should be increased and for smaller compressive forces, the compression of spring 174 should be decreased. The compressive force of the spring and hence relative pressure differentials can be controlled by varying the diameter of the flexible conduit 150, the degree of conduit flattening, and the length of the valve actuator cage 162 which is in contact with the hose in a direction normal to the cross-sectional plane of FIG. 3, i.e., the length of the flexible conduit being deformed by the valve actuator cage.

In view of the foregoing, it is evident that the present invention is one well adapted to attain all of the objects and features hereinabove setforth together with other objects and features which are inherent in the apparatus disclosed herein.

As will be readily apparent to those skilled in the art, the present invention may be produced in other specific forms without departing from its spirit or essential characteristics. The present embodiment, is therefore, to be considered as illustrative and not restrictive, the scope of the invention being indicated by the claims rather than the foregoing description, and all changes which come within the meaning and range of the equivalence of the claims are therefore intended to be embraced therein.

What is claimed is:

1. A proportional unloading valve mechanism for pressurized fluid circuits, comprising:

(a) a source of pressurized fluid flow;

(b) means forming a primary fluid circuit for receiving said pressurized fluid flow from said source under pressure;

(c) means forming a bypass fluid circuit for receiving said fluid flow from said source at low pressure;

(d) unloading valve means for selectively communicating said source with said primary fluid circuits and said bypass fluid circuit and normally being closed to maintain said source in communication with only said primary fluid circuit;

(e) valve actuator means being disposed for opening of said unloading valve;

(f) first and second pressure response members developing differing opposed pressure induced forces on said valve actuator means responsive to fluid pressure in said primary fluid circuit, said differing opposed pressure induced forces developing a resultant valve opening force on said valve actuator means in direct proportion to the pressure of fluid within said primary fluid circuit which resultant valve opening force is sufficient for opening of said unloading valve when said pressure in said primary fluid circuit reaches a predetermined maximum; and (g) means maintaining pressure in said primary fluid circuit on said pressure responsive members when said unloading valve is open to maintain said unloading valve means in the open position until the pressure in said primary fluid circuit drops to a level proportional to said predetermined maximum.

2. The proportional unloading valve of claim 1, wherein said unloading valve means comprises:

(a) a bypass inlet passage means communicating said primary fluid circuit and bypass fluid circuit;

(b) a valve seat being disposed about said bypass inlet means;

(c) a valve element being disposed for sealing engagement with said valve seat; and (d) means urging said valve element against said valve seat.

3. The proportional unloading valve of claim 1, wherein:

said unloading valve means is maintained closed at least in part by force induced by fluid pressure within said primary fluid circuit.

4. The proportional unloading valve of claim 1, wherein:

(a) said unloading valve means is a check valve being maintained closed at least in part by force developed thereon in response to pressure differential between said primary fluid circuit and bypass fluid circuit; and (b) said valve actuator means engaging said check valve and developing a valve opening force on said check valve responsive to pressure in said primary fluid circuit, said valve opening force being sufficient at said predetermined maximum pressure for opening said check valve and permitting flow of fluid from said primary fluid circuit to said bypass fluid circuit.

5. The proportional unloading valve of claim 1, wherein said first and second pressure responsive members comprise:

a pair of spaced sealing members each forming a seal between said primary and bypass fluid circuits and disposed to impart said differing pressure responsive forces to said valve actuator means, said spaced sealing members each defining different pressure responsive areas and thus defining a differential pressure responsive area, fluid pressure in said primary fluid circuit acting on said spaced sealing members and imparting a resultant force to said valve actuator means responsive to the pressure of fluid within said primary fluid circuit, said resultant force urging said valve actuator means toward a position opening said unloading valve means.

6. The proportional unloading valve of claim 1, including:

(a) means forming a valve actuator chamber having said valve actuator movably disposed therein; and (b) said first and second pressure responsive members being a pair of spaced diaphragms each defining different pressure responsive areas, the space between said diaphragms forming a part of said primary fluid circuit, the pressure of fluid within said primary fluid circuit acting on said different pressure responsive areas and developing said resultant valve opening force which urges said valve actuator means in a direction for opening said unloading valve means.

7. The proportional unloading valve of claim 1, wherein:

said means maintaining pressure from said primary fluid circuit on said pressure responsive members comprises a check valve in said primary fluid circuit being located between said unloading valve means and said first and second pressure responsive members.

8. A proportional unloading valve mechanism for pressurized fluid circuits, comprising:

(a) means forming a primary fluid circuit for receiving the flow of fluid from a pressurized fluid source;

(b) means forming a bypass fluid circuit for receiving said fluid flow from said pressurized fluid source at low pressure;

(c) unloading valve means for selectively commuicating said pressurized fluid source with said primary fluid circuit and said bypass fluid circuit and normally being closed to maintain said pressurized fluid source in communication with only said primary fluid circuit;

(d) valve actuator means being disposed for opening of said unloading valve;

(e) first and second pressure responsive members developing differing opposed pressure induced forces on said valve actuator means responsive to fluid pressure in said primary fluid circuit, said differing opposed pressure induced forces developing a resultant force on said valve actuator means in direct proportion to the pressure of fluid within said primary fluid circuit, said resultant force being sufficient for opening of said unloading valve when said pressure in the primary fluid circuit reaches a predetermined maximum; and (f) means maintaining pressure in said primary fluid circuit on said pressure responsive members when said unloading valve is open to maintain said unloading valve means in the open position until the pressure in said primary fluid circuit drops to a level proportional to said predetermined maximum pressure.

9. The proportional unloading valve mechanism of claim 8, wherein:

(a) said unloading valve is a check valve;

(b) spring means urging said check valve to the closed position thereof; and (c) said check valve being maintained closed by the force of said spring means and by pressure induced force developed thereon by differential pressure between said primary fluid circuit and said bypass fluid circuit.

10. The proportional unloading valve mechanism of claim 8, wherein said first and second pressure responsive members comprise:

a pair of diaphragms being fixed to said housing and to said unloading valve actuator and in spaced relation with one another, said diaphragms each defining different pressure responsive areas and being movable responsive to pressure differential between said primary fluid circuit and said fluid bypass circuit and imparting valve opening movement to said unloading valve actuator for movement of said unloading valve means to the open position thereof.

11. The proportional unloading valve mechanism of claim 8, wherein said first and second pressure responsive members comprise:

(a) first and second diaphragms being fixed to said housing means and to said unloading valve actuator and being disposed in spaced relation defining a chamber therebetween, said chamber forming a portion of said primary fluid circuit, said first diaphragm defining a pressure responsive area of greater dimension than said second diaphragm and thus developing a pressure induced resultant force on said unloading valve actuator for movement of said unloading valve actuator in a direction inducing opening of said unloading valve; and (b) said unloading valve being normally maintained at the closed position thereof by the resultant force developed by pressure differential between said primary fluid circuit and said fluid bypass circuit.

12. The proportional unloading valve of claim 8, wherein:

said pressure maintaining means comprises a pressure responsive unidirectional valve in said primary fluid circuit located between said unloading valve and said pressure responsive members.

13. The proportional unloading valve mechanism of claim 8, wherein said first and second pressure responsive members are sealed to said housing means and said unloading valve actuator and are disposed in spaced relation defining a chamber therebetween, said chamber forming a portion of said primary fluid circuit, said first pressure responsive member defining a pressure responsive area of greater dimension than said second pressure responsive member and thus developing a pressure induced resultant force on said unloading valve actuator for movement of said unloading valve actuator in a direction inducing opening of said unloading valve when said pressure in the primary fluid circuit reaches said predetermined maximum.

14. An unloading valve mechanism for pressurized fluid circuits, comprising:

(a) means for forming a primary fluid circuit for flow of fluid under pressure;

(b) means forming a bypass fluid circuit for receiving fluid flow from said primary fluid circuit;

(c) unloading valve means for selectively communicating said primary and bypass fluid circuits and normally being closed to maintain said primary and bypass fluid circuits out of communication;

(d) valve actuator means being disposed for opening of said unloading valve;

(e) first and second pressure responsive members developing differing opposed pressure induced forces on said valve actuator means responsive to fluid pressure in said primary fluid circuit, said differing opposed pressure induced forces developing a valve opening force on said valve actuator means in direct proportion to the pressure of fluid within said primary fluid circuit which valve opening force is sufficient for opening of said unloading valve when said pressure in said primary fluid circuit reaches a predetermined maximum; and (f) means maintaining valve opening pressure in at least a portion of said primary fluid circuit against said pressure responsive members upon opening of said unloading valve means.

* * * * *